United States Patent [19]

Smith

[11] 4,058,923

[45] Nov. 22, 1977

[54] SHOTGUN SAFETY DEVICE

[76] Inventor: Forrest D. Smith, P.O. Box 222, Orleans, Calif. 95556

[21] Appl. No.: 747,597

[22] Filed: Dec. 6, 1976

[51] Int. Cl.[2] ..... F41C 27/00
[52] U.S. Cl. ..... 42/17; 42/1 LP
[58] Field of Search ..... 42/1 R, 90, 70 R, 17, 42/1 LP

[56] References Cited

U.S. PATENT DOCUMENTS

| | | | |
|---|---|---|---|
| 2,562,037 | 7/1951 | Humeston | 42/17 |
| 3,432,956 | 3/1969 | Morrow | 42/17 |

*Primary Examiner*—Charles T. Jordan

[57] ABSTRACT

A safety clip for use with tubular magazine repeating guns which releasably grips the tubular magazine adjacent to the receiver of the gun with a finger extending into the receiver so as to contact the base of a shell in the tubular magazine and prevent it into moving into the receiver.

8 Claims, 6 Drawing Figures

SHOTGUN SAFETY DEVICE

Figure 1:
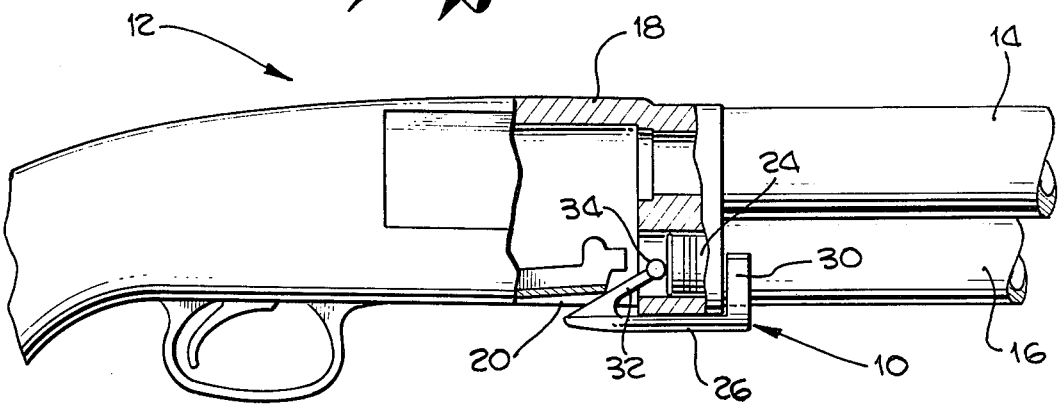

The present invention provides a detachable safety clip for use with those repeating weapons which embody tubular magazines. The present invention finds particular application in use with pump shotguns. A detachable safety clip of the present invention does not require any alteration or redesign of the weapon. The safety clip attaches resiliently to the weapon at the base of the tubular magazine where it is joined to the receiver. The safety clip is of such construction that it is very difficult to dislodge accidentally, but it is readily removable by the application of pressure at the correct location. The safety clip contacts the base of a cartridge in the tubular magazine so as to prevent the movement of the cartridge out of the tubular magazine responsive to the operation of the receiver mechanism.

Many repeating weapons which carry cartridges in tubular magazines are of such a design that the floor of the receiver opens so as to receive cartridges. This is particularly true with pump shotguns. The present invention is particularly applicable to pump shotguns having such a design.

According to the present invention a safety clip is provided which is not permanently mounted to the weapon and may be repeatedly removed and installed as desired without in any way altering the mechanism of the weapon. The safety clip permits a weapon to be stored or carried with shells in the tubular magazine without the risk of inadvertently or accidentally bringing a cartridge into the firing chamber. When it is desired to load a cartridge into the firing chamber, the safety clip can be removed very rapidly, and the action activated so as to bring a cartridge into the firing chamber. If a shell is in the firing chamber and it is desired to unload the weapon without firing it and without reloading it, the safety clip can be rapidly installed, and the action activated so as to eject the cartridge from the firing chamber without bringing another cartridge from the magazine into the firing chamber.

The safety clip is an integral structure which includes a pair of resilient arms which resiliently and releasably grasp the exterior of the tubular magazine immediately adjacent the receiver. In the operative position a level portion of the clip extends from the resilient arms rearwardly along the floor of the receiver. A finger projects outwardly from the rearwardly extending lever into the floor of the receiver where it is in position to contact the base of a cartridge which is in the exit end of the tubular magazine. The lever portion contacts the receiver immediately adjacent the resilient magazine encircling arms so that when the rearmost part of the lever is depressed, the receiver acts as a fulcrum about which the lever turns so as to pull the encircling arms out of resilient engagement with the magazine. The safety clip is installed by pressing on the clip at about the midpoint of the arc formed by the arms so as to force the arms to resiliently encircle and engage the tubular magazine. The safety clip is preferably manufactured of a resilient engineering plastic material which is of such a hardness that it will not scratch the metal of the gun. If it is desired to manufacture the safety clip from some spring metal, the metal should be coated with an organic plastic material, which is sufficiently softer than the gun metal so that it will not scratch the gun.

The accompanying drawing is submitted for the purpose of illustration only and not to limit the invention.

Figure 2:
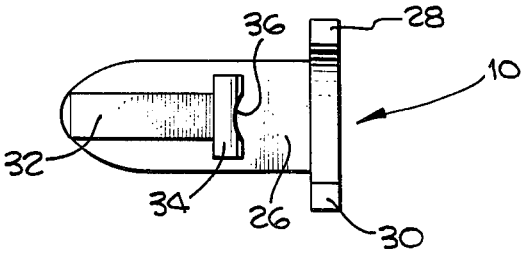
Figure 4:
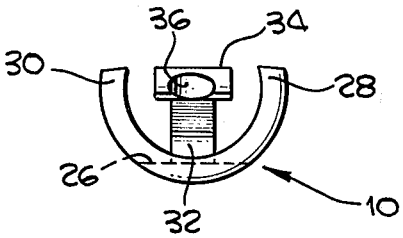
Figure 3:
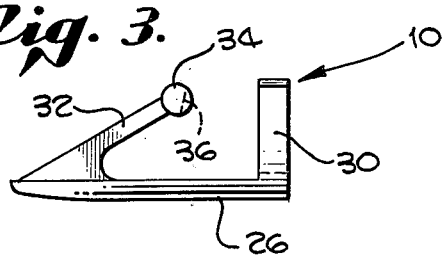
Figure 6:
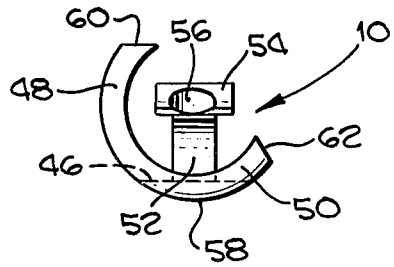
Figure 5:
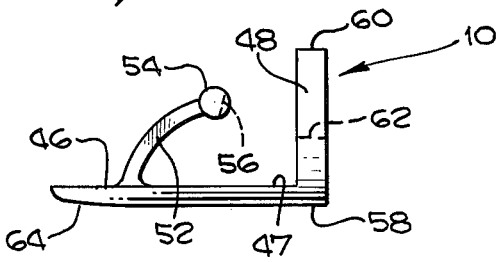

Referring particularly to the drawings, there is illustrated:

FIG. 1, a broken cross-sectional view of a portion of a pump shotgun which includes a tubular magazine, a receiver, and a barrel;

FIG. 2, a plan view of one form of a cartridge restraining device taught by the present invention;

FIG. 3, a side elevational view of the device shown in FIG. 2;

FIG. 4, a front elevational view of the device shown in FIG. 2;

FIG. 5, a side elevational view of a further embodiment of the subject matter taught by the present invention; and FIG. 6, a front elevational view of the embodiment shown in FIG. 5.

Referring particularly to the drawings, there is illustrated an integral detachable safety clip or cartridge restraining device 10 which is adapted to be mounted on pump shotgun 12 to prevent cartridges from moving out of the exit end of tubular magazine 16 into receiver 18. The mechanism of receiver 18 withdraws cartridges one at a time from tubular magazine 16, lifts them up to the level of barrel 14 and inserts them into the firing chamber, whereupon the bolt closes, and the weapon is ready to be fired. The receiver 18 includes an open floor 20 which is closed by a hinged trap in a conventional manner, so as to permit the loading of cartridges into the tubular magazine through open floor 20. For purposes of illustration, a shell 24 is shown in the exit end of tubular magazine 16.

Detachable safety clip 10 is an integral structure which includes an elongated base or lever 26 from which arms 28 and 30 project generally outwardly in an arc. The radius of the arc defined by arms 28 and 30 is approximately the same as the radius of the exterior of tubular magazine 16 so that arms or mounting members 28 and 30 partially encircle and resiliently engage the tubular magazine 16. The arc defined by 28 and 30 extends through an angle of more than 180° so that arms 28 and 30 grasp and hold tubular magazine 16. Arms 28 and 30 project generally perpendicularly to the extension of the elongated base 26. Elongated base 26 joins the arcuate member defined by arms 28 and 30 and extends generally perpendicularly to a tangent to that arc. Base 26 is attached to arms 28 and 30 in such a way that when the safety clip 10 is in its extended operative position, elongated base 26 will extend rearwardly over open floor 20. In the intended operative position elongated base 26 rests on the lower forward edge of receiver 18 and projects rearwardly over open floor 20 so that cartridge retaining member 32 projects into open floor 20 in position to contact the base of cartridge 24 at about the center line of tubular magazine 16. The portion of the cartridge retaining member or finger 32 which contacts the base of cartridge 24 is formed into an enlarged cartridge contacting portion 34 which is recessed at primer clearance recess 36 so as to prevent cartridge retaining member 32 from accidentally striking the primer in cartridge 24 and thus causing this cartridge to fire in the tubular magazine.

Referring particularly to FIGS. 5 and 6, an additional embodiment is illustrated. This embodiment is particularly suited for use with a weapon where the tubular magazine is offset somewhat in the receiver. It is necessary to shift the location at which the elongated base or lever joins the arcuate member defined by the arms in order to accommodate such an offset tubular magazine.

Lever 46 is adapted to contact the leading lower edge of a receiver at fulcrum area 47 when the resiliently releasable mounting marms 48 and 50 are releasably engaged with the base of an offset tubular magazine. Lever 46 extends rearwardly over the open floor of a receiver, and cartridge retaining member 52 projects into the open floor of the receiver so as to place the enlarged cartridge contacting portion 54 in position to contact the base of a cartridge in the tubular magazine and thus restrain it from moving into the receiver. Primer clearance recess 56 is provided so as to prevent enlarged cartridge contacting portion 54 from coming into physical contact with the primer portion of the cartridge base. Lever 46 projects generally along a line on the surface of an imaginary cylinder defined by the arc of arms 48 and 50. The lever 46, as well as lever 26, is constructed with sufficient breadth so that pressure may comfortably be applied by a human thumb to install and remove the safety clip. During the installation of the safety clip, pressure is applied by the thumb on the juncture area 58 so as to force arms 48 and 50 to flex outwardly which permits feet 60 and 62 to move apart and thus pass over the diameter of a tubular magazine. Once having passed the diameter, feet 60 and 62 flex inwardly so as to grasp the tubular magazine firmly within the arc defined by arms 48 and 50. Nothing further is required of the weapons operator to install the safety clip in operable position. Removal is accomplished by applying thumb pressure to the outer end 64 of lever 64 so that lever 46 pivots about fulcrum area 47 on the lower leading edge of the receiver, thus pulling arms 48 and 50 out of resilient engagement with the tubular magazine. Nothing further is required of the weapons operator to disengage the safety clip. The operation of the safety clip shown in FIGS. 1 through 4 is the same as that described with reference to FIGS. 5 and 6.

What is claimed is:

1. A detachable safety clip for repeating gun which gun includes a receiver, a barrel and a tubular magazine operably connected to said receiver, said detachable safety clip comprising:
   - an elongated base member;
   - means for releasably grasping said tubular magazine adjacent said receiver, said means for releasably grasping including arms projecting outwardly from said base member;
   - means for contacting a center primed cartridge to prevent said cartridge from moving out of said tubular magazine into said receiver, said means for contacting including a member projecting outwardly from said base member generally toward said arms.

2. A detachable safety clip of claim 1 wherein said cartridge includes a primer and said means for contacting includes a cartridge contact portion which is larger than the primer in said cartridge.

3. A detachable safety clip of claim 1 wherein said arms define a semicircle having an inside diameter approximately equal to the outside diameter of said tubular magazine.

4. A detachable safety clip of claim 3 wherein said member projects outwardly from said base member and terminates at a location aproximately along the center line of the semicircle defined by said arms.

5. A detachable safety clip of claim 3 wherein said elongated base member extends from said arms for a length greater than the diameter of said semicircle.

6. A detachable safety clip for a repeating gun which gun includes a barrel, a receiver and a tubular magazine, said detachable safety clip comprising:
   - an elongated base member;
   - a semicircular magazine gripping member at about a first end of said base member extending generally perpendicular to said base member; and
   - a cartridge retaining member mounted on said base member and projecting toward said magazine gripping member, said cartridge retaining member terminating at approximately the center line of the circle defined by said gripping member and adapted to contact the base of a cartridge positioned in said tubular magazine to prevent said cartridge from entering said receiver.

7. A detachable safety clip for a repeating gun which gun includes a barrel, a receiver and a tubular magazine, said detachable safety clip comprising:
   - a semicircular magazine gripping means for gripping said tubular magazine adjacent said receiver;
   - a cantilevered arm integral with said gripping means and extending generally normal to the plane of the semicircle defined by said gripping means; and
   - a cartridge retaining means integral with said cantilevered arm for contacting the base of a cartridge and preventing said cartridge from moving from said tubular magazine into said receiver.

8. A safety clip for a repeating gun, which repeating gun includes a barrel and a tubular magazine operably connected to a receiver whereby cartridges are stored in said tubular magazine and travel from said tubular magazine through said receiver and into a chamber in said barrel responsive to the operation of said receiver, said safety clip comprising:
   - removable cartridge restraining means for preventing cartridges from moving out of said tubular magazine, said removable cartridge restraining means including a resiliently releasable mounting means for holding said cartridge restraining means in operable position adjacent said tubular magazine and releasing said cartridge restraining means completely from said gun, and a finger adapted to extend into contact with a cartridge and prevent such cartridge from moving out of said tubular magazine.

* * * * *